US006763842B2

(12) United States Patent
Blount

(10) Patent No.: US 6,763,842 B2
(45) Date of Patent: Jul. 20, 2004

(54) COLLAPSIBLE AND REMOVABLE CAR PORT

(76) Inventor: Jerry M. Blount, 135 Ford St., St. Augustine, FL (US) 32095

( * ) Notice: Subject to any disclaimer, the term of this patent is extended or adjusted under 35 U.S.C. 154(b) by 12 days.

(21) Appl. No.: 09/749,151

(22) Filed: Dec. 28, 2000

(65) Prior Publication Data

US 2002/0083971 A1 Jul. 4, 2002

(51) Int. Cl.[7] ..... E04H 15/44

(52) U.S. Cl. ..... 135/132; 135/131; 135/136; 135/88.06; 52/66

(58) Field of Search ..... 135/88.06, 88.09, 135/131, 132, 133, 136, 137, 906, 116, 117; 296/136; 52/64, 66, 7; 114/361, 354

(56) References Cited

U.S. PATENT DOCUMENTS

| | | | | | |
|---|---|---|---|---|---|
| 796,864 | A | * | 8/1905 | Ramsay | 135/132 |
| 2,923,547 | A | * | 2/1960 | Heeremans | 135/133 |
| 2,992,649 | A | * | 7/1961 | Swallow | 135/132 |
| 3,036,583 | A | * | 5/1962 | Miller | 135/88.06 |
| 3,641,604 | A | * | 2/1972 | Eggert, Jr. | 14/71 |
| 3,906,968 | A | * | 9/1975 | Black | 135/133 X |
| 4,889,171 | A | | 12/1989 | Minimo | |
| 5,013,079 | A | * | 5/1991 | Ho | 296/136 |
| 5,476,127 | A | | 12/1995 | Fournier | |
| 5,738,403 | A | | 4/1998 | Tyson | |
| 5,740,826 | A | * | 4/1998 | Nevin et al. | 135/88.06 |
| 5,746,237 | A | * | 5/1998 | Arnic | 135/88.06 |
| 5,795,008 | A | | 8/1998 | Allen | |
| 5,800,006 | A | | 9/1998 | Pettigrew | |
| 5,902,003 | A | | 5/1999 | Hindson | |
| 5,921,389 | A | | 7/1999 | Zoffer | |
| 5,941,594 | A | | 8/1999 | O'Neill | |
| 6,044,881 | A | | 4/2000 | Welch et al. | |
| 6,349,732 | B1 | * | 2/2002 | Cooper | 135/116 |

FOREIGN PATENT DOCUMENTS

| | | | | |
|---|---|---|---|---|
| FR | 2653153 | * | 4/1991 | 135/132 |

* cited by examiner

*Primary Examiner*—Winnie Yip
(74) *Attorney, Agent, or Firm*—William B. Noll

(57) ABSTRACT

A collapsible vehicle storage system having a pair of spaced apart, tapered side walls, where the distance therebetween is sufficient to accommodate a vehicle. The respective sides walls pivotally mount plural U-shaped support members, with adjacent members hinged together, where the members are covered by a flexible canopy, such as canvas. At least one ratchet arm is provided to manually pivot the respective U-shaped members from an open position to a closed position.

9 Claims, 4 Drawing Sheets

COLLAPSIBLE AND REMOVABLE CAR PORT

FIELD OF THE INVENTION

This invention is directed to the field of portable and collapsible covers for motorized vehicles and boats, more particularly to a removable and collapsible cover system that can be easily operated to protect a person's automobile or boat, for example, where the convenience of a closed and permanent garage is not available.

BACKGROUND OF THE INVENTION

The present invention relates to a temporary cover, that is collapsible over a selected vehicle or automobile, to protect same against inclement weather and sun damage. Typically, especially along coastal areas, temporary car ports for vehicles and boats are found, where such car ports consist of plural, spaced apart, U-shaped members, anchored in the ground, having plural interlocking metal sheets positioned along the tops of the U-shaped members. Such structures are open at the respective ends for easy access to the stored vehicle or boat. However, they are relatively permanent and do not offer full protection against sun and salt, two particular damaging elements to painted bodies, etc.

The prior art offers a number of alternatives to these temporary car ports, where such alternatives are described in the following U.S. Patents:

a.) U.S. Pat. No. 4,889,171, to Minimo, teaches a collapsible protective canopy useful as both a sun-shade and frostshield for motor vehicles. The canopy is made of a sheet of corrugated cardboard, laminated cardboard, vinyl, leather, nylon, plastic, synthetic, or combinations thereof, or any other material in which fold line impressions, indentations or creases can be made to define parallel folds which can be stretched and compressed like the bellows of an accordion. The sheet includes a center portion and two side portions provided with belts on opposite ends of the sheet for securing the canopy to a car body. The sheet is alternately foldable to a compact package for convenient handling and storage.

b.) U.S. Pat. No. 5,476,127, to Fournier, is directed to an apparatus for a cover for the upper portion of a vehicle including the roof and all windshields. The cover is comprised of a top portion that lays flat along the roof of a vehicle, a front and back panel that drape over the respective windshields and two side panels that are attached to the front, back and top panels. Connected to the side panels are fastening devices that allow the cover to adjust to vehicles of many different sizes. Cords stretch from the either the front, the back, or all four edges of the side panels to attach to the under-side of the wheel wells by means of a hook or other fastening device. A belt is attached to each corner of each side panel. Each belt moves toward the center of the vehicle through a series of loops on the side panel. The two belts on each side meet and are fastened together at approximately mid-vehicle, pulling the cover down to snugly fit the contour of a particular vehicle. The top cover is also comprised of two flaps that are connected with both the edge of the side panel and the edge of the top panel. The flaps hang into the vehicle so that once the doors are shut and locked the cover becomes secured to the car thereby helping prevent theft.

c.) U.S. Pat. No. 5,738,403, to Tyson, relates to a vehicle protective cover includes a plurality of lightweight separable panels, each having an inner layer, a thicker shock absorbing center layer, and a substantially thinner outer layer that defines a skirt having plural spaced-apart tie-down lines for securing the cover on the vehicle with the skirt disposed extending from the vehicle in a tensioned, stand-off position.

d.) U.S. Pat. No. 5,800,006, to Pettigrew, teaches a protective vehicle cover for the prevention and reduction of damage from hail and similar free falling bodies. A reversible waterproof vinyl on two sides of an impact resistant plastic material covers the top, sides, front, and rear surfaces of a vehicle. The impact resistant material transmits the force of the impact to its opposing side to reduce the amount of force per unit of area so as to prevent damage as the force is transmitted to the vehicle. Utilization of the impact resistant material permits a product which is light weight, compact, portable, and stores easily in a vehicle trunk compartment.

e.) U.S. Pat. No. 5,941,594, to O'Neill, is directed to a protective cover for a vehicle comprised of a portion of sheet material and a number of inflatable bags. The cover is fixed to the vehicle by suitable means, for example, hooks or elastic ties, and the bags are inflated to space the sheet material a distance from the body of the vehicle. The position of the inflatable bags may be adjusted to allow the cover to be used with various vehicle body shapes. Means may be provided for simultaneous inflation or deflation of the inflatable bags. By spacing the sheet material from the body of the vehicle, the cover affords a degree of protection to the vehicle from falling projectiles and other such hazards.

While the above prior art protective systems offer some help in covering a vehicle against the elements of the weather, none provide the ease and flexibliity of a protective system that can be moved to selected locations and suitable anchored against excessive wind damage. The manner by which the present invention achieves such goals will become apparent in the description which follows

SUMMARY OF THE INVENTION

This invention is directed to a portable and collapsible vehicle storage system, such as may be used to protect an automobile or boat against inclement weather. The system comprises a generally U-shaped base having an opening wide enough to accommodate the vehicle. The base consists of an end wall having a pair of generally parallel side walls extending therefrom. The respective side walls mount a plurality of pivotal, U-shaped canopy support members, where adjacent said members are hinged to one another. Overlying and attached to said support members is a flexible canopy top, such as may be made of canvas. At least one ratchet arm is provided to manually pivot the joined U-shaped members from an open position in which the vehicle may be parked, to a closed position containing and covering the vehicle. Temporary anchoring means are provided to secure both the base and the closed canopy to the ground. Further, a removably secured opening may be provided to access the closed canopy top, as well as a light transmitting window. In a preferred system, the plural U-shaped support members have varying heights, where said support members are sequentially arranged from the shortest near the end wall to the longest near the open end of the base.

Accordingly, an object of this invention is to provide a simple, yet effective, portable vehicle storage system that may be readily placed at selected locations.

Another object hereof is the provision of a closable canopy top by manual means.

A further object of the invention lies in the use of plural, U-shaped support members mounting a flexible canopy top, where the plural support members are moved sequentially by a single ratchet member.

These and other objects of the invention will become apparent to those skilled in the art from the description which follows.

DETAILED DESCRIPTION OF PREFERRED EMBODIMENTS

Figure 1:
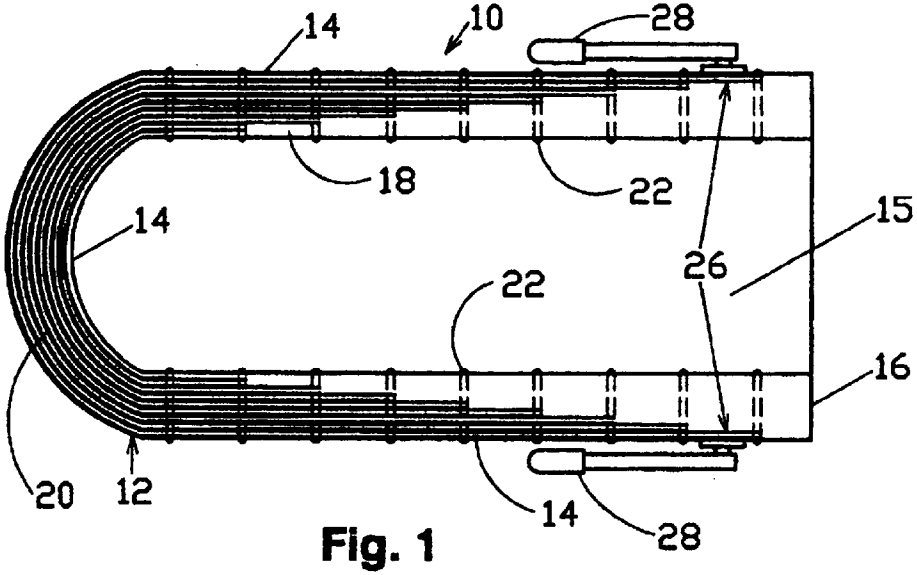
FIG. 1 is a top view showing a first embodiment of the collapsible and removable vehicle storage system according to the present invention, where the car port is shown in the fully opened position prior to parking a vehicle therein for protection against the weather.

The present invention teaches a portable and collapsible vehicle storage system, such as for automobiles and boats, to protect the vehicle against inclement weather. The storage system will now be described with regard to the several Figures, where like reference numerals represent like components or features throughout the various views.

Figure 2:
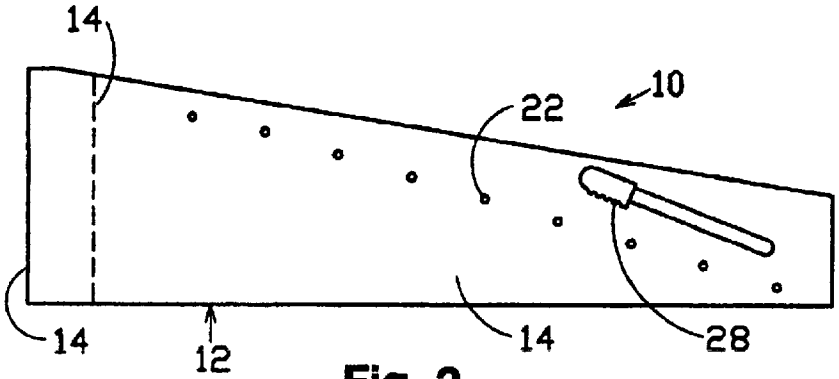
FIG. 2 is a side view of the system of FIG. 1.

Turning first to FIGS. 1 and 2, illustrating the system 10 of this invention, there is shown a U-shaped base 12 comprising a pair of spaced apart upstanding walls 14, a floor 15, with open ends 16 and top 18. Within said walls 14 are plural spaced apart, U-shaped canopy support members 20, pivotally mounted by pivot joints 22 for movement relative to said base 12, see also FIGS. 3 and 4 for further details.

Figure 3:
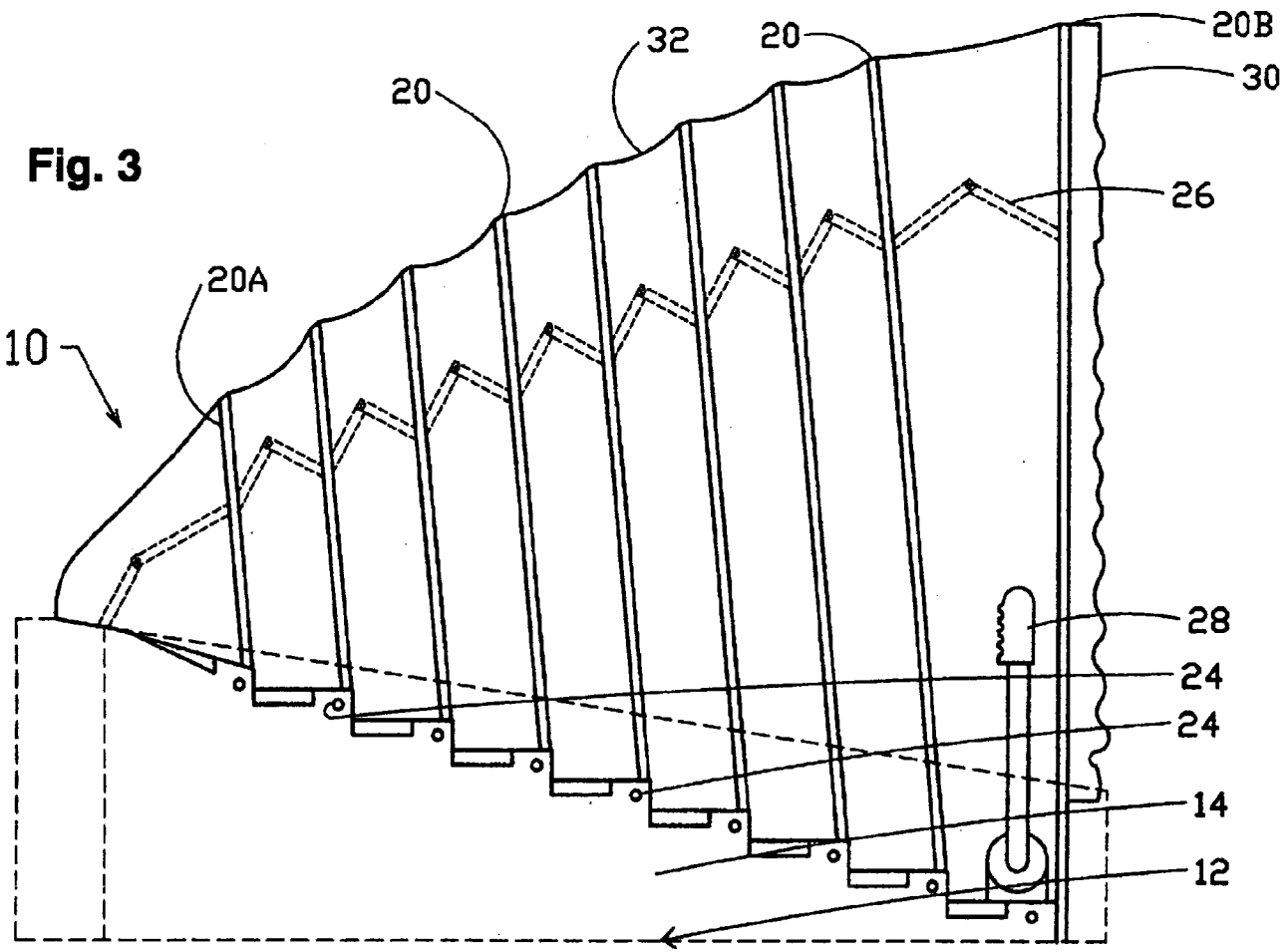
FIG. 3 is a side view of the system, less an automobile, further showing a pair of power bars for closing the canopy top over the stored vehicle.
Figure 4:
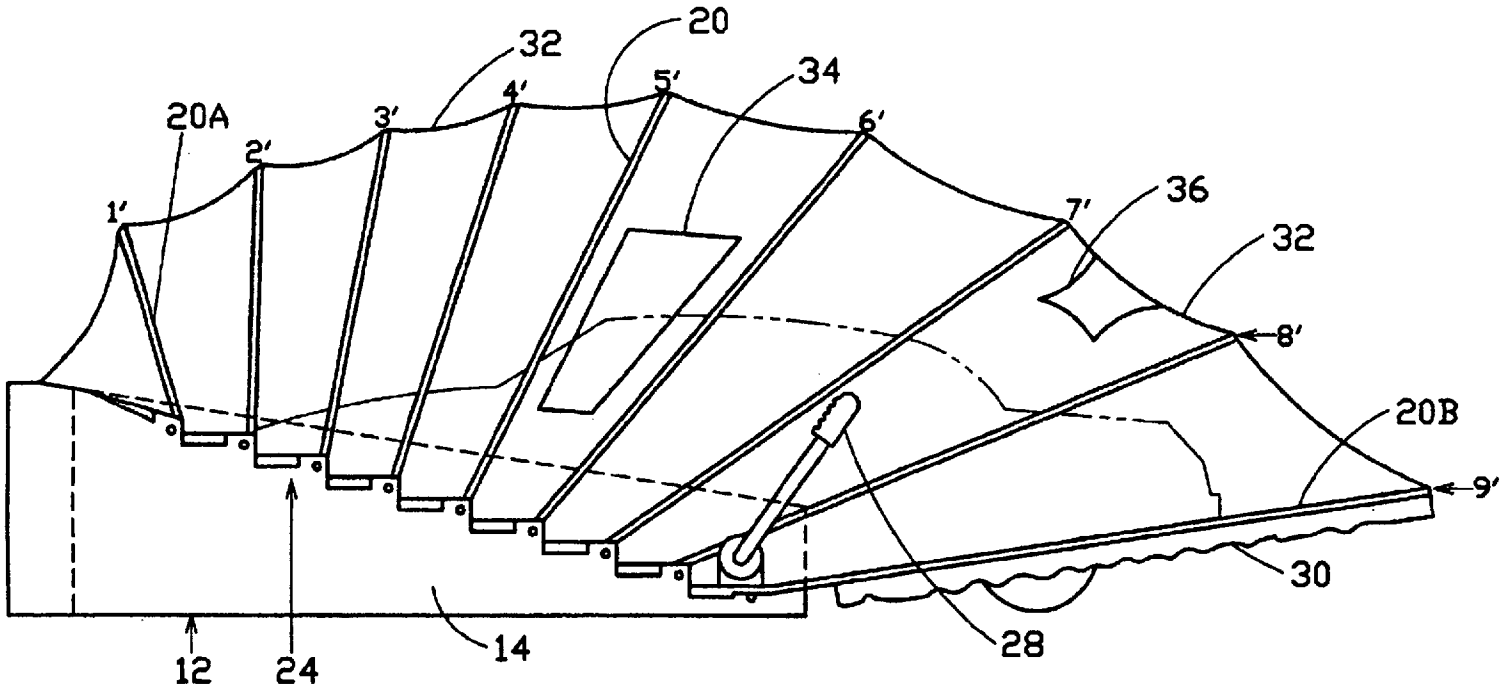
FIG. 4 is a side view of the system of this invention showing the canopy fully closed, with the profile of a vehicle shown in profile.

FIG. 3 illustrates the system 10 in a partially opened position. It appears that the U-shaped canopy support members 20 are arranged in step like fashion, but in reality they are pivotally mounted on a bracket 24 secured to the side wall, rather than a pivoting rod extending between walls, where the brackets, as known in the art, allow for the easy pivoting of said support members 20. In any case, the support members 20 are preferably made of a light weight material, such as aluminum. While the width or breadth between the open ends 26 are essentially the same, the height varies from the rear most support member 20A (shortest) to the forward most support member 20B (longest), where the intermediate support members incrementally increase from rear to front. In a preferred arrangement, the system may consist of nine supports with the respective heights from one foot to nine feet. Additionally, as best seen in FIG. 3, adjacent said support members 20 are joined by simple hinges 26, preferably one hinge per side, to maintain the spatial relationship of the support members in the fully extended position, see FIG. 4. To pivot the respective support members 20 from the open position to the closed position, a ratchet arm lever 28, as known in the art, is provided at the forward end of the system. For convenience, a pair of such arm levers may be included, one for each side. Also, as seen in FIGS. 3 and 4, the forward most support member 20B may be provided with a gasket member 30 to contact the ground in the closed position (FIG. 4) and help seal the enclosure. Overlying and secured to the respective support members 20 is a canopy 32, such as made of canvas, or similar type of flexible material.

As seen in FIG. 4, the canopy 32 may include a flexible access door 34, which may be zippered to the canopy material, or secured by VELCRO, a commercial product for a hook and pile type fastening system. Additionally, a flexible window 36 may be provided to allow the owner of the vehicle to inspect same without removing the canopy 32 or door 34.

Figure 5:
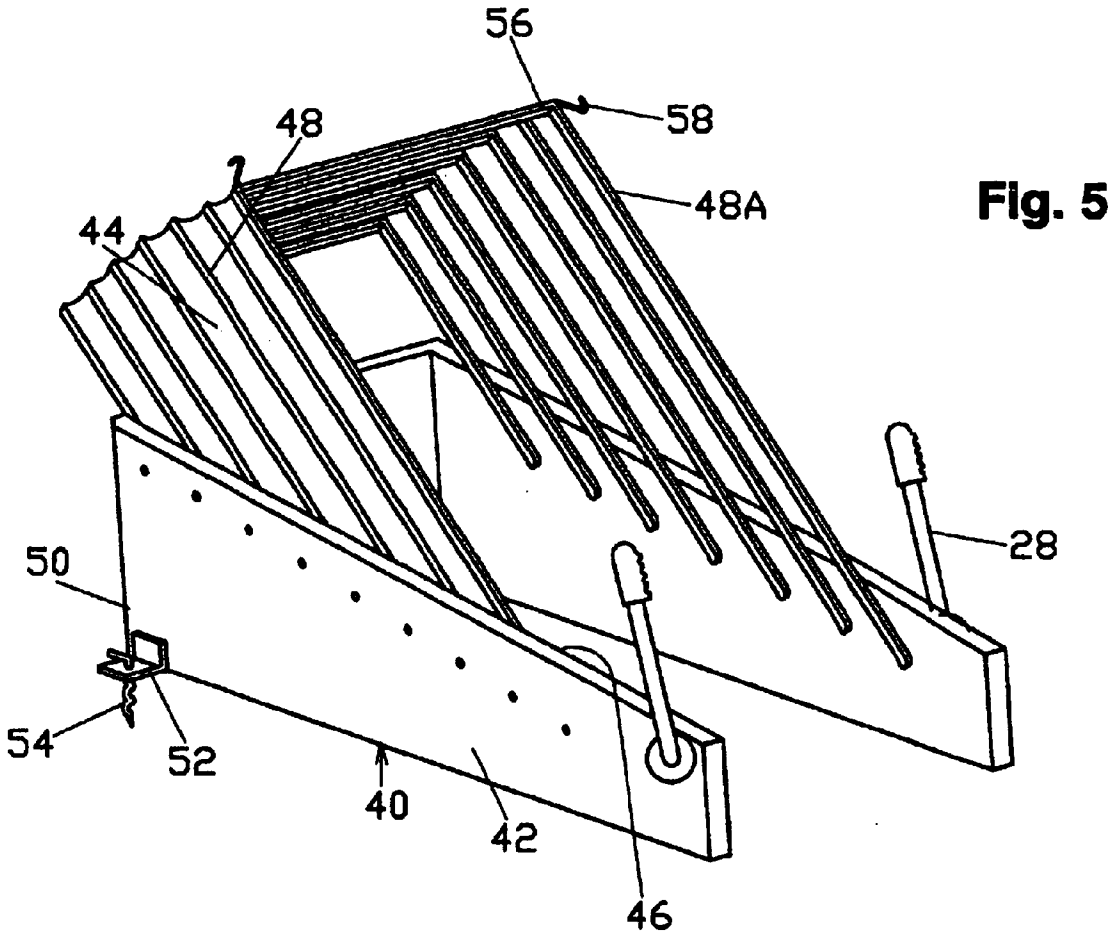
FIG. 5 is a perspective view showing an alternate embodiment for the collapsible and removable vehicle storage system of this invention.

FIG. 5 illustrates an alternative embodiment to the system of FIGS. 1 through 4. The base 40 comprises a pair of tapered and parallel side walls 42 and a rear wall 44, where the distance between the side walls 42 is sufficient to accommodate the vehicle to be protected therein. Mounted along the upper tapered edge 46 of the side walls 42 are the pivotal, plural canopy support members 48 as described above. To removably anchor the base 40 to the ground, the forward ends 50 of the side walls 42 are provided with L-shaped brackets 52 for receiving complementary helical anchoring members 54. Additionally, the upper corners 56 of the forward most support member 48A may include hooks 58 for engaging complementary anchors, not shown, in the ground in the fully extended position.

It is recognized that changes, variations and modifications may be made to the system of this invention without departing from the spirit and scope thereof, particularly by those skilled in the art. Accordingly, no limitation is intended to be imposed on the invention, except as set forth in the accompanying claims.

What is claimed is:

1. A collapsible and removable vehicle storage system for protecting a vehicle against inclement weather, said system comprising:

a.) a U-shaped base having a pair of parallel side walls, each having a free end and joined together at an opposite end by an intermediate wall, where the respective side walls at the top edges are tapered downwardly from said intermediate wall toward said free ends, with the respective lower edges lying in a plane for contacting the ground; and, b.) a pivotally mounted canopy top overlying said base, said canopy top comprising plural U-shaped supports having a pair of free ends, where said free ends are pivotally secured to said tapered side walls, and adjacent said U-shaped supports are hingedly secured to another to allow separation of said adjacent supports from an open position to a closed position, and a continuous flexible canopy top overriding said plural U-shaped supports, said flexible canopy top being movable from a tight open position to a stretched closed position by means of a manually operated ratchet assembly mounted at said free ends, and the end most U-shaped support essentially lying within said plane and mounting a gasket member to provide a seal against said ground in said closed position.

2. The collapsible and removable vehicle storage system according to claim 1, including access means in said flexible canopy top for entering the system m said closed position.

3. The collapsible and removable vehicle storage system according to claim 1, including anchoring means for removably securing said base to said ground.

4. The collapsible mid removable vehicle storage system according to claim 1, wherein said U-shaped supports have the same breadth between said free ends, but different heights, where the shortest said support is the most remote from said ratchet assembly, and the remaining said supports are arranged by heighth toward said outer most said support adjacent said ratchet assembly.

5. The collapsible and removable vehicle storage system according to claim 4, wherein said tapered side include individual brackets, where each said bracket pivotally mounts a single said U-shaped support.

6. The collapsible and removable vehicle storage system according to claim 4, including at least one flexible light transmitting window in said flexible canopy top for visually inspecting the interior of said canopy.

7. The collapsible and removable vehicle storage system according to claim 4, wherein said outer most said support includes at least one anchoring members for removably securing said flexible canopy top to said ground in said closed position.

8. The collapsible and removable vehicle storage system according to claim 1, including a floor extending between said side walls.

9. The collapsible and removable vehicle storage system according to claim 1, wherein the side walls of said U-shaped base comprises a pair of spaced apart walls to receive said U-shaped supports therebetween in said open position.

* * * * *